United States Patent [19]

Gryctko

[11] 4,132,967

[45] Jan. 2, 1979

[54] UNITIZED COMBINATION STARTER

[75] Inventor: Carl E. Gryctko, Bellefontaine, Ohio

[73] Assignee: I-T-E Imperial Corporation, Spring House, Pa.

[21] Appl. No.: 681,690

[22] Filed: Apr. 29, 1976

[51] Int. Cl.[2] ..... H01H 73/00

[52] U.S. Cl. ..... 335/11; 335/6; 335/159

[58] Field of Search ..... 335/6, 8, 11, 16, 159; 337/6

[56] References Cited

U.S. PATENT DOCUMENTS

| | | | |
|---|---|---|---|
| 2,850,596 | 9/1958 | Clausing | 335/11 |
| 3,638,157 | 1/1972 | Kruzic | 337/6 |
| 3,987,382 | 10/1976 | Cataldo et al. | 335/6 |

*Primary Examiner*—Harold Broome

*Attorney, Agent, or Firm*—Ostrolenk, Faber, Gerb & Soffen

[57] ABSTRACT

A unitized combination motor starter includes a unitized insulating base for an electromagnetic contactor section and a circuit breaker section having automatic trip means. The unitized base is part of a common insulating housing for the contactor and circuit breaker sections and circuit elements serially connecting these sections are disposed within the common housing.

5 Claims, 4 Drawing Figures

FIG. 3.
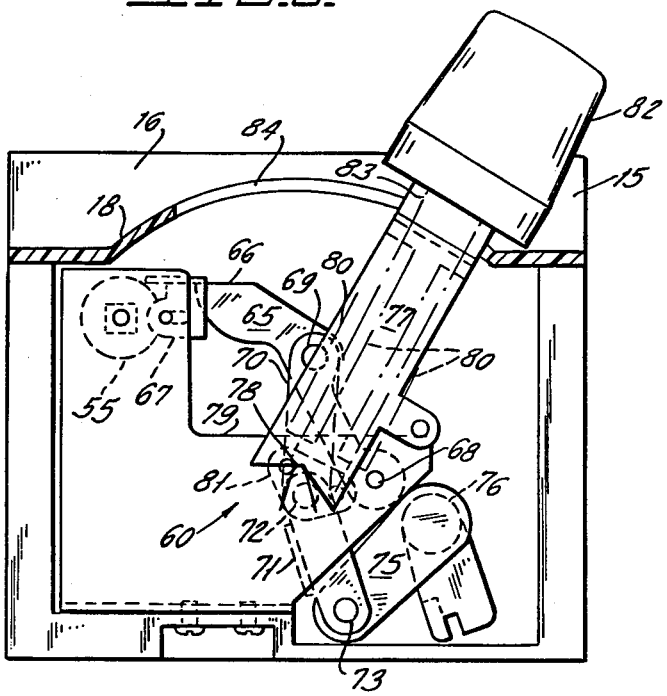
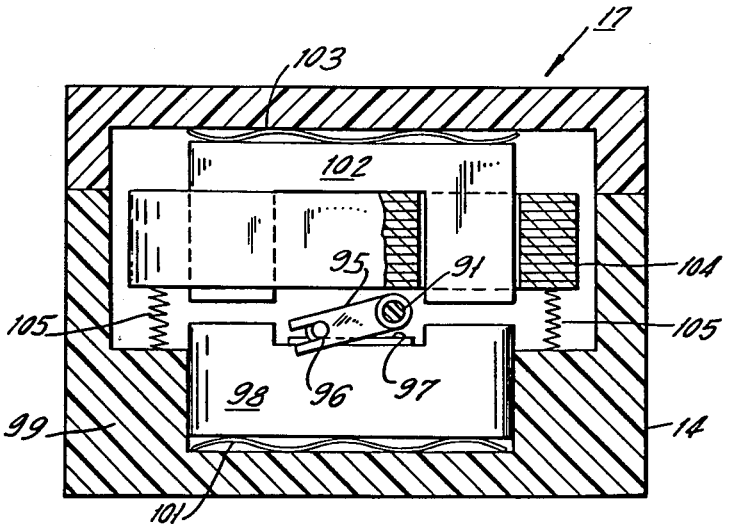
FIG. 4.

UNITIZED COMBINATION STARTER

This invention relates to motor starters in general and more particularly relates to a unitized device including an electromagnetic contactor and a manually operable switching means.

In the prior art, so-called combination motor starters often consisted of an electromagnetic contactor unit wired to a separate switch or circuit breaker unit. This type of apparatus was usually bulky and was often deficient from an electrical standpoint because the individual contactor and switch units available were not compatible to the extent necessary for achieving reliable operation under all conditions.

In accordance with the instant invention, a combination motor starter, including an electromagnetic contactor and a manually operable circuit breaker having an automatic trip means, is provided with a unitized insulating base to which the contactor and circuit breaker are mounted. The base is part of a common molded insulating housing wherein the contactor and circuit breaker are disposed. Factory installed circuit elements disposed within the housing connect the contactor and circuit breaker in series.

Accordingly, a primary object of the instant invention is to provide a novel unitized combination motor starter including an electromagnetic contactor in combination with a switch or circuit breaker.

Another object is to provide a combination motor starter having a unitized insulating base as part of a common molded insulating housing wherein a contactor and circuit breaker and their main circuit interconnecting elements are disposed.

These objects as well as other objects of this invention shall become readily apparent after reading the following description of the accompanying drawings in which:

FIG. 3 is a cross-section taken through line 3—3 of FIG. 1 looking in the direction of arrows 3—3 and showing the elements of the manual operating mechanism for the circuit breaker portion.

FIG. 4 is a cross-section taken through line 4—4 of FIG. 1 looking in the direction of arrows 4—4 and showing elements of the electromagnetic operative for the contactor portion.

Figure 1:
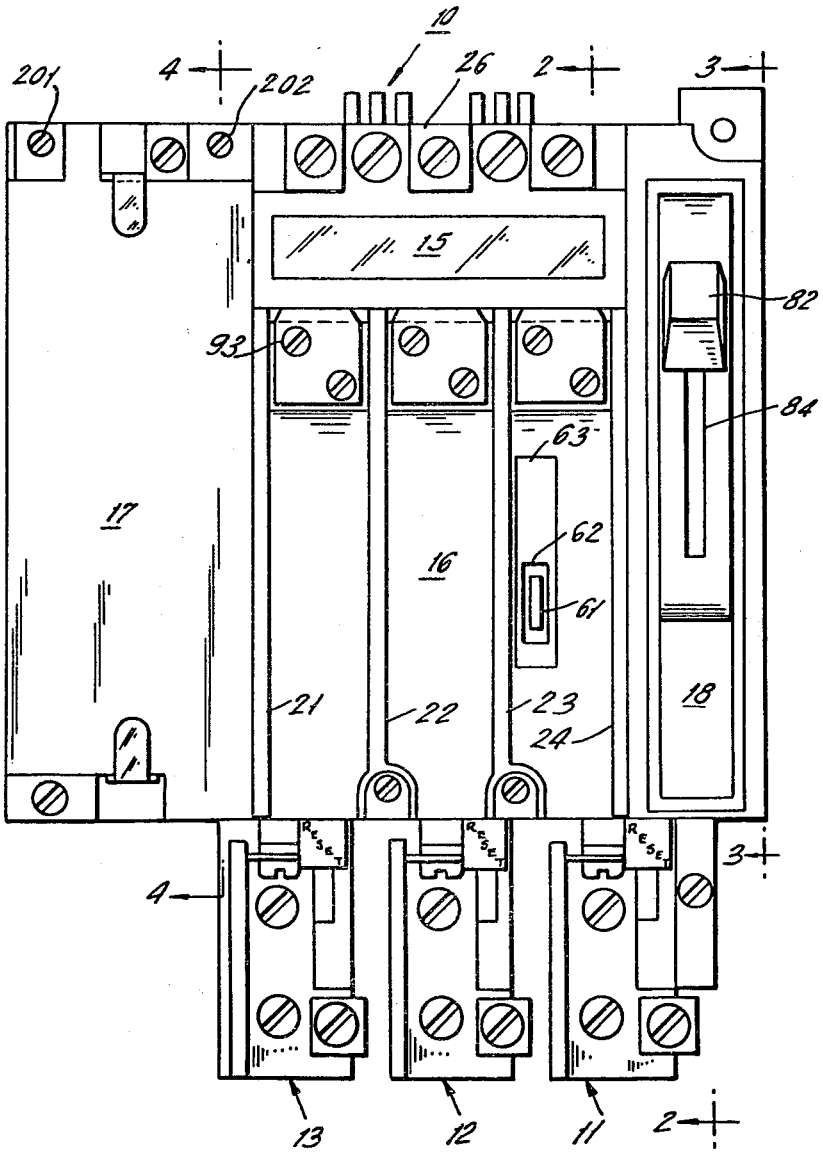
FIG. 1 is a plan view of a unitized combination motor starter constructed in accordance with teachings of the instant invention and connected to overload relay means.

Now referring to the figures. In FIG. 1 unitized combination motor starter is shown with three overload relay units 11, 12, 13 connected to starter 10 at its load end and including U-shaped replaceable bimetal heater. Each of the overload relay units is of a type described in detail in U.S. Pat. No. 3,226,510 issued Dec. 28, 1965, to Thomas et al. for An Electric Overload Switch With Improved Thermal Actuator.

Figure 2:
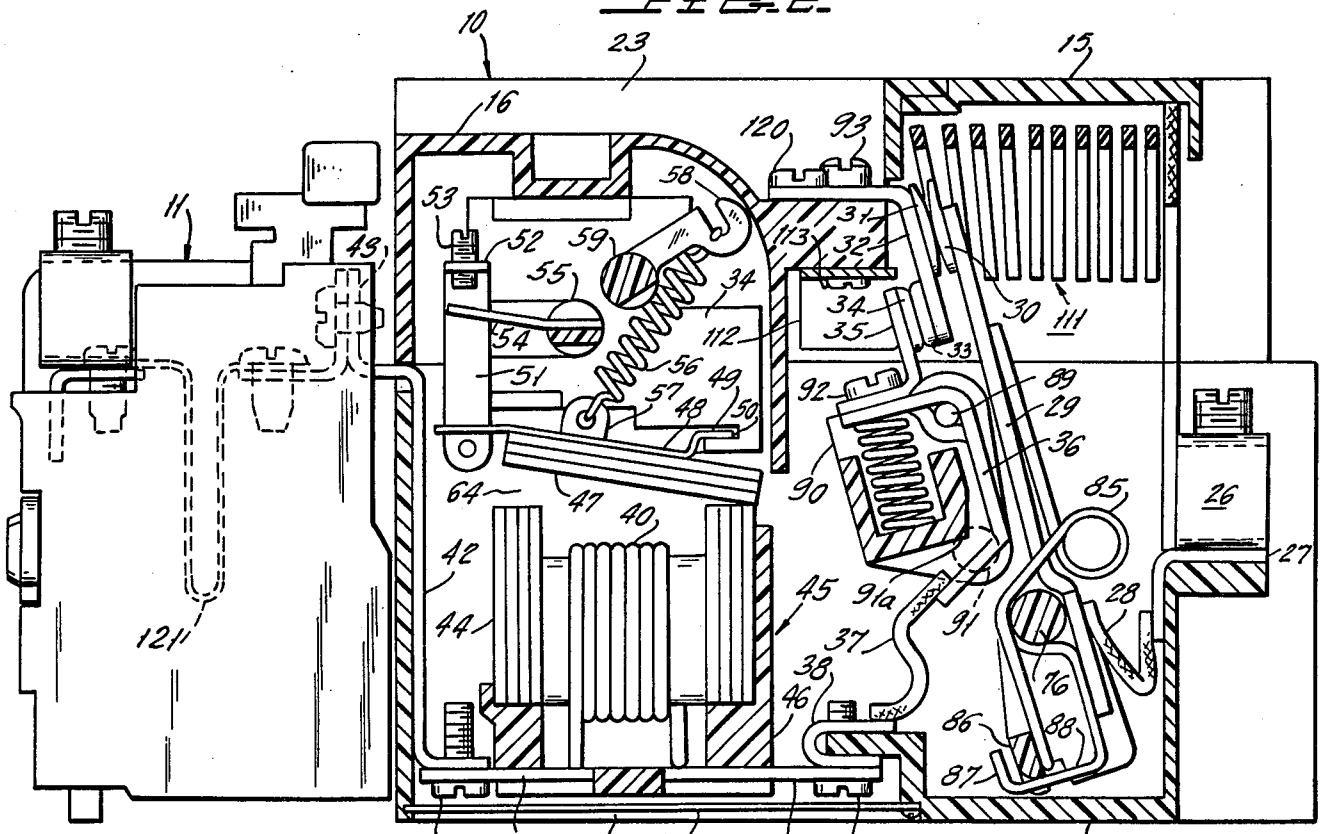
FIG. 2 is a cross-section taken through line 2—2 of FIG. 1 looking in the direction of arrows 2—2 and showing the elements of one pole unit.

Unitized starter 10 includes a molded insulating housing consisting of unitized insulating base 14 and removable cover portions 15, 16 17 and 18. Cover portion 16 includes four longitudinally extending parallel ribs 21-24 aligned with similar ribs in base 14 to form three compartments each of which house elements identical to those illustrated in FIG. 2. These elements include the current-carrying elements for each of the three poles of starter 10. Similarly, cover section 15 is provided with internal ribs (not shown) aligned with ribs 21-24.

The current-carrying path for each of the pole units is identical so that only one of these paths shall be described. This path includes wire grip 26, line terminal 27, flexible braid 28, movable switch contact arm 29, movable switch contact 30, stationary switch contact 31, terminal strap 32, stationary contactor contact 33, movable contactor contact 34, movable contactor switch arms sections 35, 36, flexible braid 37, U-shaped terminal 38, strap 39, overload sensing coil 40, strap 41, and strap 42 having an offset upper end constituting load terminal 43.

Coil 40 is part of removable and replaceable circuit breaker calibrating assembly 45 that is secured in operative position by a pair of screws 19, 19 accessible at the rear of base 14 by removing plate 74 which normally covers opening 94. Coil 40 is wound about the web section of U-shaped magnetic yoke 44 which, together with the other elements 39-41 of assembly 45, are secured to mounting member 46. Movable armature 47 is secured to spring element 48 having offset end 49 which extends into base recess 50 to operatively position armature 47. The end of member 48 opposite offset 49 is secured to the lower end of connector 51 having offset upper end 52 through which adjusting screw 53 extends. The lower end of screw 53 is engageable with the free end of extension 54 projecting generally radially from pivoted common tripper bar 55. The latter extends transversely through all of the pole units and into the compartment housing circuit breaker operating mechanism 60 (FIG. 3), for a reason to be hereinafter explained.

Coiled tension spring 56 is connected at one end to ear 57 extending upward from element 48 and at the other end is connected to the free end of crank 58 extending generally radially from pivoted common adjusting rod 59. Rod 59 is held in its angularly adjusted position by means of a spring (not shown) which engages indentations in arm 62. Rod 59 is moved to a desired angular position by inserting a tool (not shown) into slot 61 at the free end of arm 62 that projects radially from rod 59 and is accessible through aperture 63 in the portion of cover part 16 between ribs 23, 24. Spring 56 biases the left end of armature 47 (when viewed in FIG. 2) away from yoke 44 to form air gap 64 in the magnetic frame 44, 47, gap 64 being constant regardless of the position of crank 58.

When the flux in magnetic frame 44, 47 generated by current flow in sensing coil 40 exceeds a predetermined level, armature 47 is attracted to yoke 44, carrying screw 53 into engagement with extension 54 whereby rotating tripper bar 55 in a counterclockwise direction. This releases intermediate latch 67 (FIG. 3) which, in turn, releases latching tip 66 of cradle 65. The latter is mounted to fixed pivot 68 and at a point 69 intermediate the ends of cradle 65. The latter is pivotally connected to upper toggle arm 70 which is connected to lower toggle arm 71 at knee 72 and is pivotally connected at pin 73 to the end of crank 75 remote from contact tie rod 76 keyed to crank 75. Handle extension 77 is pivotally mounted at its lower end to formation 78 of mechanism frame 79 and is biased thereagainst by a pair of coiled tension springs 80, 80 connected at their upper ends to handle extension 77 and at their lower ends to triangular plate 81 through which toggle knee pin 72 extends. Manually engageable operating handle 82 is removably mounted to the upper end 83 of handle extension 77. End 83 of extension 77 extends through and rides in slot 84 (FIG. 1) of operating mechanism cover 18.

It should now be apparent that circuit operating mechanism 60 is of the trip-free spring powered overcentered toggle type well known to the circuit breaker art. Thus, when the line of action of operating springs 80, 80 shifts to collapse toggles 70, 71 tie bar 76 is pivoted clockwise with respect to FIGS. 2 and 3. Since contact arms 29 of all poles are mounted to tie rod 76, contact arms 29 also pivot clockwise thereby separating circuit breaker contacts 30, 31. Looped wire spring 85 bears against base formation 86 and contact arm 29 to bias the latter in a counterclockwise direction thereby normally supplying contact pressure. When contacts 30, 31 are disengaged, the counterclockwise motion of contact arm 29 is limited through the cooperation of base formation 86 and the upturned end 87 of member 88 which clamps contact arm 29 to tie bar 76.

Contact arm section 36 is mounted to pivot 89 on formation 98 which extends generally at right angles to the longitudinal axis of tie rod 91. Coiled compression spring bears against formation 90 and arm portion 36 to bias the latter clockwise with respect to FIG. 2 about pivot 89 as a center. This, in turn, provides contact pressure between contactor contacts 33, 34 when the latter are engaged. Portion 91*a* of formation 90 is engaged by arm portion 36 to limit clockwise movement of the latter when contactor contacts 33, 34 are disengaged. When cover portion 16 is removed, screw 92 connecting contacting arm portions 35, 36 is accessible for removal and replacement of removable contactor contact 34. Screw 93, accessible from the outside of cover portion 16, removably secures strap 32 in this operative position so that stationary contactor contact 33 may readily be removed and replaced.

Tie bar 91 extends into the housing compartment containing the electromagnet operator for contactor movable contacts 34. In this compartment tie bar 91 is keyed to one end of crank 95 whose other end is provided with an open-ended slot into which pin 96 extends. The latter projects from element 97 secured to movable U-shaped magnetic armature 98 mounted in holder 99 cushioned from base by corrugated spring 101. Inverted U-shaped yoke 102 is secured to cover portion 17 and is cushioned with respect thereto by corrugated spring 103. Double-loop magnet operating coil assembly 104 is mounted to yoke 102 and is biased upwardly by coiled compression springs 105, 105 which bear against armature 98 and also serve to bias the latter away from stationary yoke 102. When the coil assembly 104 is energized by an energizing voltage applied at terminals 201, 202, the flux in magnetic frame 98, 102 attracts armature 98 to yoke 102 thereby pivoting crank 95 clockwise with respect to tie rod 91 as a center. In turn, this causes clockwise rotation of tie rod 91 to pivot contactor movable contact arm 35, 36 clockwise with respect to FIGS. 2 and 4 thereby closing contactor contacts 33, 34.

The elements forming parallel plate arc chute 111 (FIG. 2) are secured to cover portion 15 on the interior thereof in operative position to facilitate extinction of arcs drawn between circuit breaker contacts 30, 31. Similarly, U-shaped steel element 112 is secured to the interior of cover portion 16 by screw 113 in operative position to assist in extinguishing arcs drawn between contactor contacts 33, 34. Screw 120 is threadably mounted to stationary contact member 31 to act as a binding post for making electrical connections through circuit breaker contacts 30, 31 to line terminal 27 without going through contactor contacts 33, 34. This type of electrical connection is required for certain control circuit configurations or when a reversing type contactor operation is desired.

While unitized motor starter 10 has been described as including an electromagnetic contactor in series with an automatic circuit breaker, it should be apparent to those skilled in the art that a unitized motor starter utilizing many features of the instant invention may be constructed by substituting a manually operated switch for the circuit breaker. It should also be apparent to those skilled in the art that the contactor portion may be provided with bridging type contacts to provide a double break. Further, provisions may be made to change the sensing coil and its magnetic yoke through an opening at the front of the starter rather than changing same through a rear opening as hereinbefore described.

Although there has been described a preferred embodiment of this novel invention, many variations and modifications will now be apparent to those skilled in the art. Therefore, this invention is to be limited not by the specific disclosure herein but only by the appending claims.

What is claimed is:

1. A switching device including a plurality of side-by-side pole units each having separable switch contact means, separable contactor contact means, conductor means connecting said contactor contact means in series circuit with said switch contact means; a unitized molded insulating base whereon both said switch and contactor contact means are mounted; a common insulating housing means including said base as an element thereof positioned at the rear of said housing means; said housing means also including cover means in front of said base and removably mounted thereto; said cover at the rear thereof including a plurality of ribs aligned and cooperating with a plurality of ribs at the front of said base to form a plurality of side-by-side internal compartments, one for each of said pole units; both said switch and contactor contact means and said conductor means being disposed within said housing means, with an individual set of said switch contact means being disposed within an individual one of said compartments.

2. A switching device as set forth in claim 1 also including trip means for automatically opening the switch contact means upon the occurrence of predetermined fault current conditions.

3. A switching device as set forth in claim 2 also including a manually operable spring powered mechanism for opening and closing the switch contact means; said mechanism including an operating handle accessible at the front of said housing means.

4. A switching device as set forth in claim 3 also including an electromagnet for closing said contactor contact means.

5. A switching device as set forth in claim 1 also including, for each of said pole units, line and load terminals at opposite ends of the housing means; and means within said housing means, including said contactor and switch contact means and said conductor means defining a conducting path between said line and load terminals.

* * * * *